US010247144B2

(12) United States Patent
Keppy

(10) Patent No.: US 10,247,144 B2
(45) Date of Patent: Apr. 2, 2019

(54) ENGINE EXHAUST GAS RECIRCULATION COOLING SYSTEM WITH INTEGRATED LATENT HEAT STORAGE DEVICE

(71) Applicant: Robert Bosch GmbH, Stuttgart (DE)

(72) Inventor: Brent Keppy, Waterford, MI (US)

(73) Assignee: Robert Bosch GmbH, Stuttgart (DE)

( * ) Notice: Subject to any disclaimer, the term of this patent is extended or adjusted under 35 U.S.C. 154(b) by 1082 days.

(21) Appl. No.: 14/061,101

(22) Filed: Oct. 23, 2013

(65) Prior Publication Data

US 2014/0345579 A1 Nov. 27, 2014

Related U.S. Application Data

(60) Provisional application No. 61/825,963, filed on May 21, 2013.

(51) Int. Cl.

| | |
|---|---|
| ***F02M 26/00*** | (2016.01) |
| ***F02M 26/32*** | (2016.01) |
| ***F02M 26/30*** | (2016.01) |
| *F01P 11/20* | (2006.01) |
| *F02N 19/04* | (2010.01) |

(52) U.S. Cl.

CPC ..... *F02M 26/32* (2016.02); *F02M 26/30* (2016.02); *F01P 2011/205* (2013.01); *F01P 2060/16* (2013.01); *F02N 19/04* (2013.01)

(58) Field of Classification Search

CPC ..... F02M 25/0737; F02M 25/0735; F02M 25/0726; F02M 25/07; F02M 25/001; F02N 19/04; F01P 11/08; F01P 2060/16; F01P 2011/205; Y02T 10/121

USPC ..... 123/568.12, 568.17, 568.21, 41.33; 701/108; 60/278, 280, 298; 62/5

See application file for complete search history.

(56) References Cited

U.S. PATENT DOCUMENTS

| | | | | |
|---|---|---|---|---|
| 3,861,142 | A * | 1/1975 | Bose | 60/274 |
| 3,937,196 | A * | 2/1976 | Cook et al. | 123/568.12 |
| 4,258,677 | A * | 3/1981 | Sanders | F02N 19/10 123/142.5 R |
| 5,611,392 | A * | 3/1997 | Malecek et al. | 165/47 |
| 5,901,572 | A * | 5/1999 | Peiffer | B60H 1/00 165/104.12 |
| 6,334,437 | B1 * | 1/2002 | Jessberger | F02M 25/0703 123/568.12 |
| 6,895,752 | B1 * | 5/2005 | Holtman et al. | 60/605.2 |
| 7,467,605 | B2 * | 12/2008 | Szalony et al. | 123/41.04 |
| 7,628,144 | B2 * | 12/2009 | Vetrovec | 123/559.1 |

(Continued)

FOREIGN PATENT DOCUMENTS

| | | | |
|---|---|---|---|
| KR | 0759516 | * 10/2007 | 123/568.12 |

*Primary Examiner* — David E Hamaoui
*Assistant Examiner* — Susan E Scharpf
(74) *Attorney, Agent, or Firm* — Michael Best & Friedrich LLP

(57) ABSTRACT

A method includes operating an internal combustion engine producing, as a byproduct, exhaust gases. The flow of exhaust gases are segregated into a first, relatively hot flow and a second, relatively cold flow. The second flow is directed to an intake of the internal combustion engine for combustion with fresh intake air and fuel. Heat energy from the first flow is stored in a latent heat storage device. Heat energy is released from the latent heat storage device to reduce cold start emissions during a subsequent operation of the internal combustion engine after a period of shutoff.

9 Claims, 3 Drawing Sheets

(56) References Cited

U.S. PATENT DOCUMENTS

| | | | | |
|---|---|---|---|---|
| 7,685,819 | B2 * | 3/2010 | Vetrovec | 60/611 |
| 8,220,442 | B2 * | 7/2012 | Caldwell | 123/568.12 |
| 2007/0125346 | A1 | 6/2007 | Vetrovec | |
| 2007/0272174 | A1 | 11/2007 | Szalony et al. | |
| 2008/0133110 | A1 | 6/2008 | Vetrovec | |
| 2008/0179039 | A1 | 7/2008 | Moilala et al. | |
| 2011/0048388 | A1 * | 3/2011 | Takahashi | B01J 23/63<br>123/568.11 |
| 2011/0192141 | A1 | 8/2011 | Schepers et al. | |
| 2011/0240249 | A1 * | 10/2011 | Powell et al. | 165/41 |
| 2012/0125300 | A1 * | 5/2012 | Caldwell | 123/568.12 |

* cited by examiner

ENGINE EXHAUST GAS RECIRCULATION COOLING SYSTEM WITH INTEGRATED LATENT HEAT STORAGE DEVICE

CROSS-REFERENCE TO RELATED APPLICATIONS

This application claims priority to U.S. Provisional Patent Application No. 61/825,963, filed May 21, 2013, the entire contents of which are incorporated by reference herein.

BACKGROUND

The present invention relates to internal combustion engines with reduced emissions. This applies to combustion engines that utilize exhaust gas recirculation (EGR) to effectively reduce engine emissions, and also to engine applications that benefit from faster warm-up behavior of the engine. Internal combustion engines that meet today's strict emissions regulations quite often employ EGR as a method to dilute the oxygen concentration of the combustion, and thereby reduce the formation of oxides of nitrogen. In order to effectively introduce enough EGR to the engine's intake manifold, the EGR is usually cooled by an EGR cooler to increase the density of EGR and prevent high combustion temperatures. These coolers are typically cooled by engine coolant, which increases the heat that must be removed by the vehicle's radiator and fan assembly.

SUMMARY

In one aspect, the invention provides a method including operating an internal combustion engine producing, as a byproduct, exhaust gases. The flow of exhaust gases are segregated into a first, relatively hot flow and a second, relatively cold flow. The second flow is directed to an intake of the internal combustion engine for combustion with fresh intake air and fuel. Heat energy from the first flow is stored in a latent heat storage device. Heat energy is released from the latent heat storage device to reduce cold start emissions during a subsequent operation of the internal combustion engine after a period of shutoff.

In another aspect, the invention provides an internal combustion engine including a plurality of cylinders operable to combust a mixture of fuel and air. A vortex tube is coupled to the plurality of cylinders to receive a flow of exhaust gases from the plurality of cylinders. The vortex tube is operable to separate the flow of exhaust gases into a first, relatively hot flow discharged from a first outlet and a second, relatively cold flow discharged from a second outlet. An exhaust gas recirculation passage couples an intake of the engine and the second outlet of the vortex tube. A latent heat storage device is coupled to the first outlet of the vortex tube and is operable to store a quantity of heat energy supplied by the second flow. The latent heat storage device is coupled in heat exchange relationship with at least one of engine oil, engine coolant, and a catalyst.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
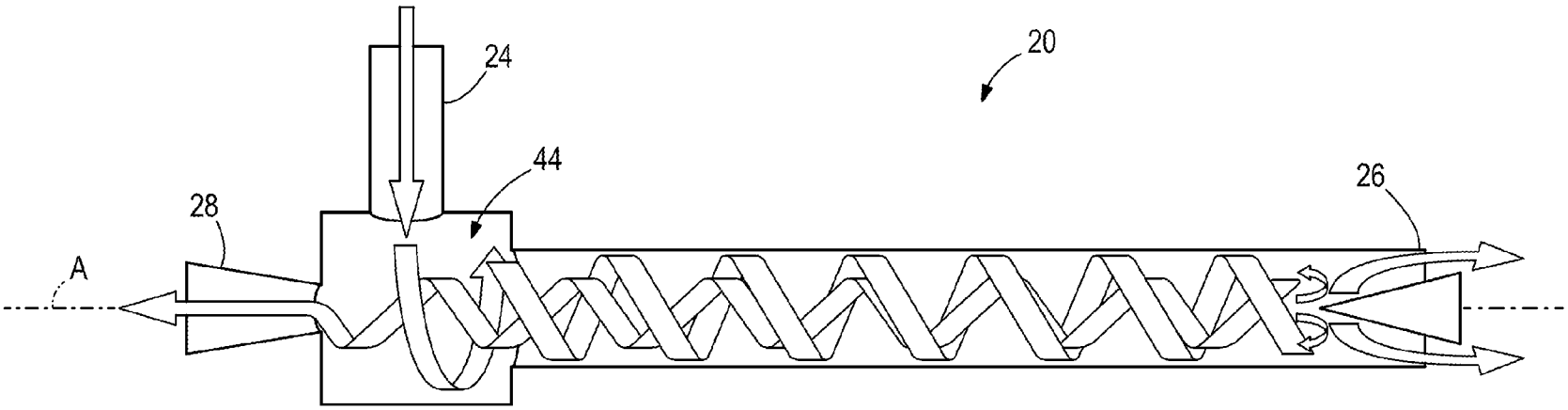
FIG. 1 is a schematic view of a vortex tube.

FIG. 1 illustrates a vortex tube 20, known as a Ranque-Hilsch vortex tube. The vortex tube 20 has an inlet 24 and a pair of opposed outlets 26, 28. The inlet 24 is configured to admit a flow of gas substantially normal to an axis A, and the outlets 26, 28 are arranged at opposite axial ends of the vortex tube 20 to output separate flows of gases, substantially along the axis A. The vortex tube 20 is a mechanical device configured to segregate a gas flow by temperature into a first, relatively hot flow exhausted through the first outlet 26 and a second, relatively cold flow exhausted through the second outlet 28.

Figure 2:
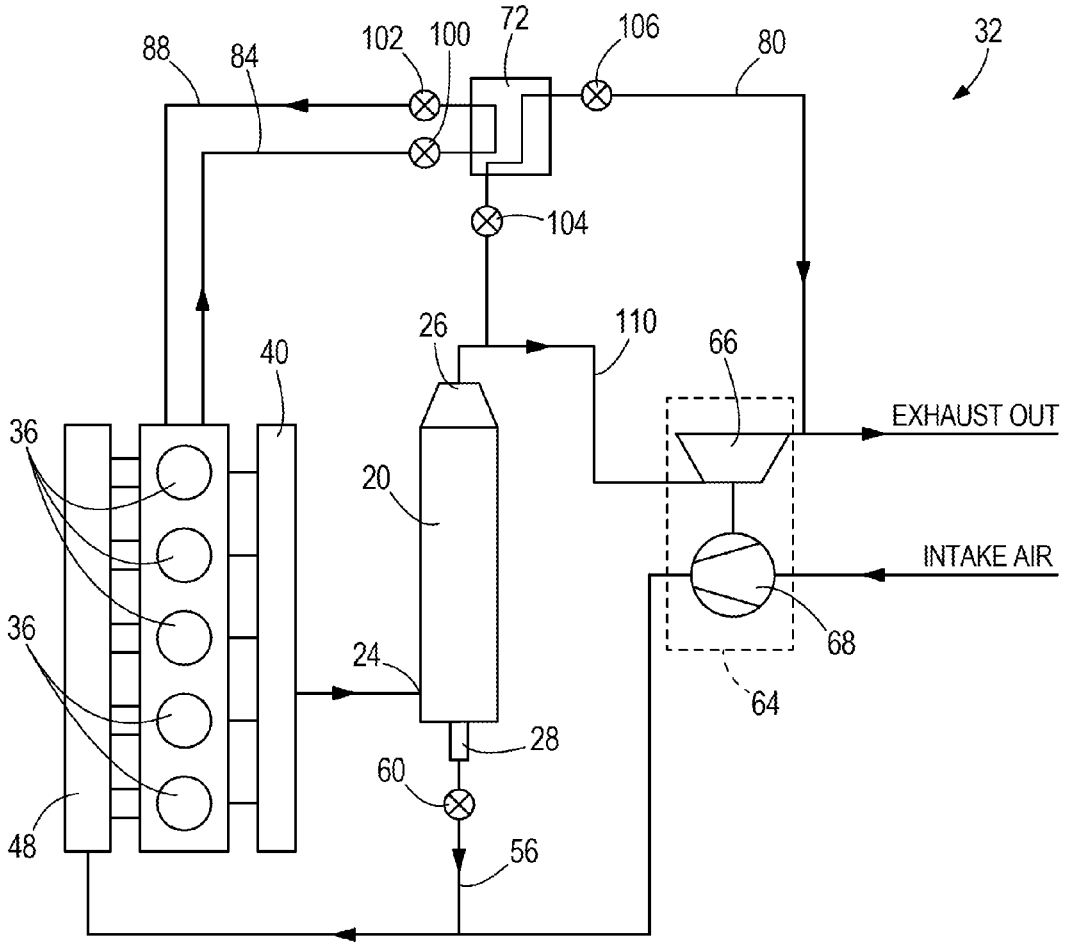
FIG. 2 is a schematic view of an internal combustion engine including a vortex tube coupled to receive exhaust gases and a latent heat storage device coupled to a hot-side outlet of the vortex tube.

FIG. 2 illustrates the vortex tube 20 arranged within an internal combustion engine 32 to receive exhaust gases from the combustion process that occurs within the cylinders 36 of the engine 32. In other words, the inlet 24 of the vortex tube 20 is coupled to an exhaust manifold 40 configured to receive exhaust gases from each cylinder 36 when the corresponding exhaust valve 42 is opened. The vortex tube 20 as shown in FIG. 1 has no moving parts. Exhaust gas enters an interior chamber 44 of the vortex tube 20 through the inlet 24 (from the top in FIG. 1) and generates a vortex that flows toward the first outlet 26. When the vortex reverses direction adjacent the first outlet 26, only relatively hot gases are allowed to escape through the first outlet 26. The remaining gas, which is relatively cooler, returns toward the second outlet 28, from which it is expelled. Today's EGR cooler technology is prone to fouling, due to the tight spacing of the cooling tubes and fins. The vortex tube 20 has much less propensity to fouling due to the simple mechanical design. The energy losses associated with the pressure drop through the cooler must be considered in sizing the vortex tube 20, however the pressure drop through the cooler is normally generated conventionally across the EGR control valve itself.

Figure 3:
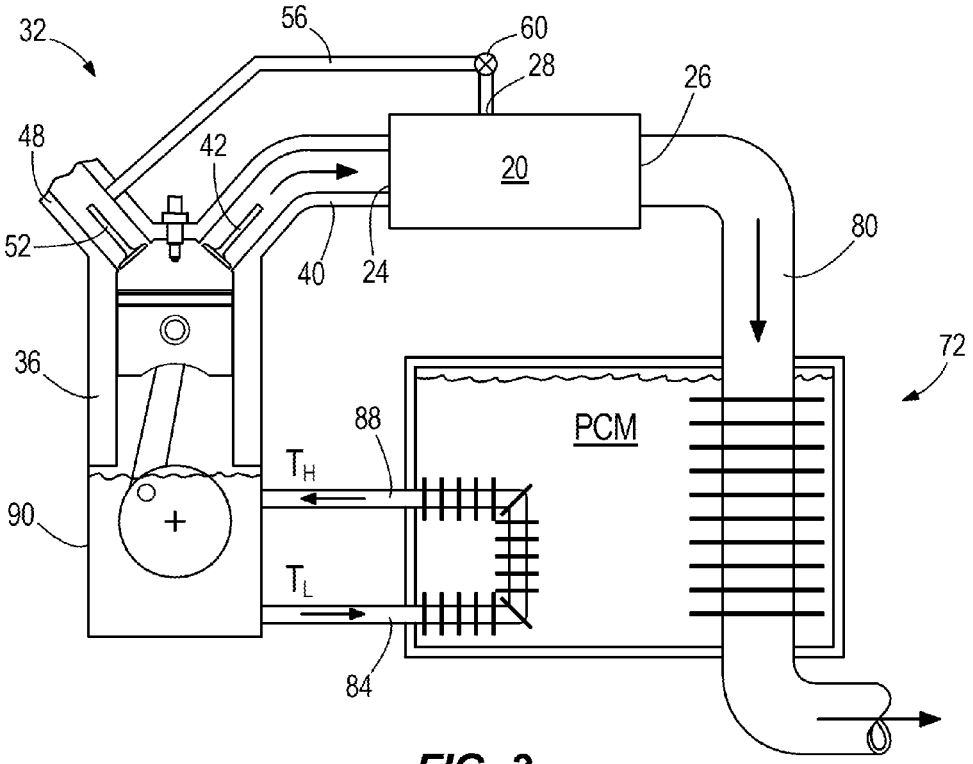
FIG. 3 is a cross-section view of the internal combustion engine of FIG. 3, including the latent heat storage device.

The relatively cold stream is routed to an intake manifold 48 of the engine 32 to provide cooled EGR to the cylinders 36 through the corresponding intake valves 52. As illustrated in FIGS. 2 and 3, the second outlet 28 can be coupled to the intake side of the engine 32 via an EGR supply line 56. An EGR control valve 60 can be positioned between the second outlet 28 and the intake manifold 48 and operable to modulate the flow rate through the EGR supply line 56. Although not required in all aspects of the invention, the engine 32 can be turbocharged. As such, a turbocharger 64 can be provided with an exhaust-side turbine 66 and an intake-side compressor 68 in order to utilize exhaust gas energy to increase intake airflow. The relatively hot exhaust stream from the first outlet 26 of the vortex tube 20 is reintroduced to the exhaust system to be expelled. However, heat from the flow of exhaust gas exiting the first outlet 26 can be taken useful advantage of, as described in further detail below.

In some aspects of the invention, the hot exhaust stream from the vortex tube 20 is passed through a Latent Heat Storage (LHS) device 72 that is configured to capture heat from the exhaust gas for later use. One challenge for modern engine efficiency improvement and emissions reduction is the behavior of the engine and exhaust system when the system is started from an ambient temperature condition. In other words, when starting an engine after it has been completely cooled down to the ambient temperature after a period of shutoff (i.e., "cold start"). When an engine is cold, internal friction between moving parts, including the pistons within the cylinders, is significantly high. This is mostly due to the high viscosity of engine oil when cold, and results in relatively poor fuel efficiency. The engine must produce extra power to overcome the higher level of friction induced by cold oil. Additionally, a cold engine produces relatively cold temperature exhaust gas. Modern catalysts that reduce HC, CO and $NO_x$ emissions require a certain light-off temperature before they are effective in reducing emissions. This warm-up time can last several minutes after cold start before acceptable temperatures are reached, during which, high levels of emissions are experienced. Thus, cold starting can be a leading contributor in emissions in modern engines, especially where vehicles are used frequently for short trips and/or in cold weather in which a very large portion of the sum total of emissions may be generated during the warm-up period. The LHS device 72 is configured to capture or absorb heat from the relatively hot exhaust stream from the vortex tube 20 and is further configured to store this heat for use in warm-up assistance on a subsequent cold start. For example, using the LHS device 72 to rapidly heat the engine oil is an effective and inexpensive way to reduce engine friction, and improve the engine's warm-up characteristics, thereby reducing cold start emissions. Friction can be reduced by heating the engine oil directly, or by heating engine coolant, which in turn heats the engine block and engine oil to achieve faster warm-up to normal operating temperature. Alternatively, or in addition, the relatively hot exhaust from the first outlet 26 of the vortex tube 20 can be utilized to achieve faster catalyst warm-up, further improving engine emissions levels. For example, after storage within the LHS device 72, heat can be released to the catalyst through any desired mechanism establishing a heat exchange relationship therebetween. Regardless of how the heat is used during cold start, the relatively hot gases escaping the vortex tube 20 through the first outlet 26 can be used to charge the LHS device 72 to a higher energy state than with conventional exhaust directly from the exhaust manifold 40. This presents the advantage of using the LHS device 72 in combination with the vortex tube 20, which is that the benefit for warm-up is amplified due to the increased amount of heat that can be stored.

Figure 4:
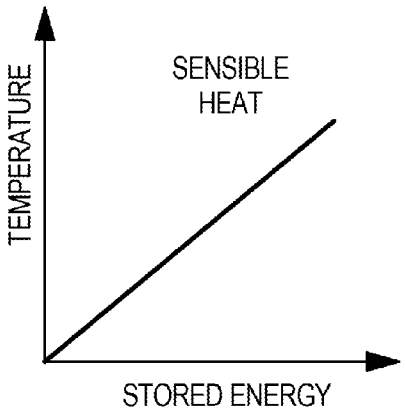
FIG. 4 is a graph of temperature versus stored energy for a sensible heat increase.
Figure 5:
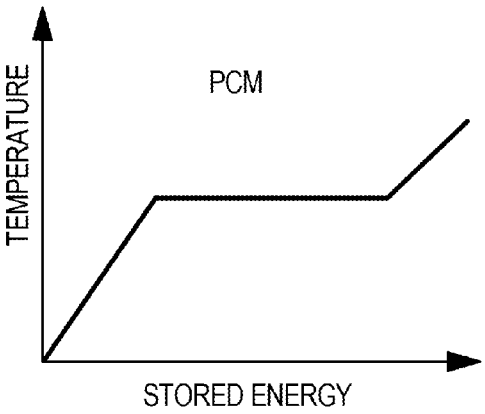
FIG. 5 is a graph of temperature versus stored energy for a phase change material including an increase of combined sensible and latent heat.

The LHS device 72 can contain a phase change material (PCM) that is capable of storing and delivering a high amount of thermal energy. This is primarily due to the high level of energy stored or delivered during the process of phase change (e.g., solid to liquid, and back). The characteristic of temperature vs. stored energy without phase change (sensible heat only) and with phase change are shown, respectively, in FIGS. 4 and 5. As illustrated, the phase change affords a substantial amount of energy storage capability at the phase transition temperature, whereas a significant temperature differential is required with sensible heat alone. The PCM can be paraffin wax, as an example. However, other materials may alternately be used to match specific temperatures ranges experienced. The LHS device 72 is an insulated chamber that defines a volume containing the PCM and is capable of storing the heat accumulated for a relatively long time (several hours to several days). The amount of thermal storage is directly a function of the temperature of the "heating fluid" introduced to the LHS device 72. In this case, the hot portion of engine exhaust from the first outlet 26 of the vortex tube 20 is the heating fluid. The heating fluid flows through an exhaust pipe 80 that passes through the insulated chamber of the LHS device 72 that contains the PCM. The exhaust pipe 80 is closed with respect to the contents of the LHS device 72 so that exhaust gases are not mixed with the PCM. As shown, the exhaust pipe 80 can be formed with heat transfer-aiding structure (e.g., fins) to enhance the heat transfer between the hot exhaust gases and the PCM. In the illustrated example of FIGS. 2 and 3, an oil pipe having send 84 and return 88 portions (from and back to an oil reservoir 90 of the engine 32) also passes through the insulated chamber of the LHS device 72. Like the exhaust pipe 80, the oil pipe can include heat transfer-aiding structure (e.g., fins) to enhance the heat transfer between the PCM and the cold oil flowing therein, and the oil and PCM are kept out of fluid contact by the oil pipe. In an alternate construction, also represented by FIG. 2, the pipe including the send and return portions 84, 88 can be an engine coolant pipe in fluid communication with coolant channels in one or more of the engine block and cylinder head(s) of the engine 32.

During operation of the engine 32, the hottest fraction of the exhaust gas, from the vortex tube 20, is used to heat the PCM in the LHS device 72. Upon stopping, the engine 32 cools down from normal operating temperature, and if stopped long enough, reaches ambient temperature. When the engine 32 is re-started, engine oil is routed through the LHS device 72 via the oil pipe send 84 and return 88 and is heated by the PCM, which has stored the heat energy throughout the period between shutoff and re-start. This heating of the engine oil happens very fast, and can very quickly heat the oil (e.g., increasing oil temperature from $T_L$ to $T_H$), and thus reduce friction so that fuel consumption is reduced to a level corresponding with normal operating temperature in much shorter duration from start-up. In some constructions, as shown in FIG. 2, one or more valves can be provided on the oil pipe and/or the exhaust pipe 80 for selectively turning ON and OFF the respective fluid flows through the LHS device 72. For example, a first valve 100 can be provided on the oil pipe send 84 and a second valve 102 can be provided on the oil pipe return 88. The first and second valves 100, 102 are closed during storage of heat into the LHS device 72 and are open during warm-up assistance by the LHS device 72. Furthermore, first and second valves 104, 106 can be provided, respectively, in the exhaust pipe 80 on the upstream and downstream sides of the LHS device 72. The first and second valves 104, 106 are open during storage of heat into the LHS device 72 and are closed during warm-up assistance by the LHS device 72. Once the LHS device 72 has been discharged of thermal energy during a warm-up assist cycle, it can be recharged by closing the oil heating circuit (closing valves 100, 102) and again passing the hot exhaust gas through the LHS device 72 (with exhaust valves 104, 106 open). The position of all the valves 100, 102, 104, 106 can be controlled by a controller or ECU (not shown) in response to a monitored time and/or temperature (e.g., oil temperature, PCM temperature, or engine water/coolant temperature). When the exhaust pipe 80 is blocked by one or more valves 104, 106, exhaust gases from the first outlet 26 of the vortex tube 20 are passed through to the exhaust system (e.g., to the turbocharger turbine 66) via an auxiliary or bypass exhaust pipe 110 running in parallel with the exhaust pipe 80 that passes through the LHS device 72.

A similar operation is carried out in the case where engine coolant, rather than oil, is the fluid heated by the PCM. It should also be noted that the LHS device 72 can be used to establish heat transfer to any combination of engine oil, engine coolant, and a catalyst.

What is claimed is:

1. A method comprising:

operating an internal combustion engine producing, as a byproduct, exhaust gases;

segregating the flow of exhaust gases into a first, relatively hot flow and a second, relatively cold flow;

directing the second flow to an intake of the internal combustion engine for combustion with fresh intake air and fuel;

storing heat energy from the first flow in a latent heat storage device; and releasing heat energy from the latent heat storage device to a catalyst, in order to reduce cold start emissions during a subsequent operation of the internal combustion engine after a period of shutoff.

2. The method of claim 1, wherein segregating the exhaust gases includes directing the exhaust gases through a vortex tube, the first flow passing through a first outlet and the second flow passing through a second outlet.

3. The method of claim 1, wherein the heat energy is stored in and released from a phase change material provided within a volume defined by the latent heat storage device.

4. The method of claim 3, wherein the storing of heat energy is accomplished by flowing the first flow through a closed exhaust pipe extending through the volume.

5. The method of claim 4, wherein the releasing of heat energy is accomplished by flowing engine oil through a closed oil pipe extending through the volume.

6. The method of claim 4, wherein the releasing of heat energy is accomplished by flowing engine coolant through a closed coolant pipe extending through the volume.

7. The method of claim 1, wherein the releasing of heat energy includes releasing heat energy to engine oil.

8. The method of claim 1, wherein the releasing of heat energy includes releasing heat energy to engine coolant.

9. The method of claim 1, further comprising metering the second flow with an exhaust gas recirculation valve.

* * * * *